United States Patent [19]

Katzman

[11] Patent Number: 4,505,497

[45] Date of Patent: Mar. 19, 1985

[54] MULTI-COLORED WRAPPER LABEL WITH READABLE DATA ON BOTH SIDES

[76] Inventor: Abe Katzman, 40 Carthage Rd., Scarsdale, N.Y. 10583

[21] Appl. No.: 529,946

[22] Filed: Sep. 7, 1983

Related U.S. Application Data

[62] Division of Ser. No. 280,337, Jul. 6, 1981, abandoned.

[51] Int. Cl.[3] ..... B42D 15/00

[52] U.S. Cl. ..... 283/81; 101/211; 101/426; 283/901; 283/94; 427/266

[58] Field of Search ..... 101/426, 211; 40/324, 40/360; 283/81, 94, 901, 904; 427/265, 266; 434/347, 344

[56] References Cited

U.S. PATENT DOCUMENTS

| | | | |
|---|---|---|---|
| 1,867,314 | 7/1932 | Gurwick | 101/211 X |
| 2,084,026 | 6/1937 | Gurwick | 101/426 X |
| 2,158,633 | 5/1939 | Normandi et al. | 427/266 |
| 2,167,305 | 7/1939 | Kropp | 40/310 |
| 2,251,144 | 7/1941 | Lytle | 427/266 X |
| 2,337,348 | 12/1943 | Prindle | 101/426 X |
| 4,143,183 | 3/1979 | Rupp et al. | 427/266 |

*Primary Examiner*—Paul A. Bell

*Attorney, Agent, or Firm*—Angelo Notaro

[57] ABSTRACT

A Multi-colored composite print is provided on one side of a transparent medium to produce conventionally readable data when viewed from either side. In one embodiment, a first color, on one side of the medium, provides a solid area in that color. Data that is conventionally readable, when viewed from the opposite side, is also formed on that side. A second color, lighter than the first color, is applied to the one side excluding a subarea of the first color so as to provide second readable data which is conventionally readable when viewed from the one side. The first and second readable data are correlated.

14 Claims, 3 Drawing Figures

MULTI-COLORED WRAPPER LABEL WITH READABLE DATA ON BOTH SIDES

RELATED APPLICATION

This application is a division of application Ser. No. 280,337, filed July 6, 1981, now abandoned.

This invention relates to multi-colored printing and, more particularly, to a process for printing multi-colored composite prints on transparent film, especially for use as article wrappers.

The printing of multi-colored composite prints on transparent film is well known. Typically, a rotary printing press is used to pass transparent film from a supply reel between an impression cylinder and a plurality of printing cylinders to a take-up reel. Each of the printing cylinders is engraved to print a different color of the composite print.

When the composite print is to be an article wrapper, all of the printing is usually done on one side of the transparent film. If it is desired to have conventionally readable data on both sides of the transparent film, then a second separate printing is done at a correspondingly increased cost.

The general object of this invention is to provide a process for printing a multi-colored composite print on one side of the transparent film and yet have conventionally readable data viewable from each side.

A further object of the invention is to provide a process for economically printing an article wrapper with conventionally readable data viewable from each side of the wrapper.

A specific object of the invention is to provide a process for printing on one side of transparent film candy wrappers which have printed questions viewable from the outside and answers viewable from the inside of the wrappers.

Briefly, in accordance with the preferred embodiment of the invention, a process for printing a multi-colored composite print one one side of a transparent medium, such as plastic film or sheeting, comprises the steps of: (a) printing on what will be the inside of the transparent medium that portion of the composite print comprising a first color and including a solid area in that color as well as conventionally readable data when viewed from the outside of the transparent medium; and (b) then printing in a second color lighter than the first color, also on the inside of the transparent medium, that portion of the composite print comprising the second color, except over the solid area of the first color where no printing is done in subareas comprising additional data which is conventionally readable in the first color when viewed from the inside of the transparent medium.

Thus, in accordance with one aspect of the invention, there is provided a process for printing a multi-colored composite print on one side of a transparent medium to produce conventionally readable data when viewed from either side comprising the steps of: (a) printing on what will be the inside of the transparent medium that portion of the composite print comprising a first color and including a solid area in that color (as well as conventionally readable data) when viewed from the outside of the transparent medium, and (b) then printing in a second color lighter than the first color, also on the inside of the transparent medium, that portion of the composite print comprising a second color, except over the solid area of the first color where no printing is done in subareas comprising additional data which is conventionally readable in the first color when viewed from the inside of the transparent medium. Additional colors may be printed in separate steps between the first and second colors and also in increasing order of lightness. Plastic film may be used when article wrappers are to be printed and heavier sheet plastic used for transparent multi-colored articles like book covers. Alternatively, all of the printing is done on the outside of the transparent medium but the lighter color is printed first except for the subareas comprising data, and then a darker solid area is printed over the data area so that the data may be conventionally read when viewed from the inside of the transparent medium. A multi-colored contrasting background area may be substituted for the solid area, whether the printing is done on the inside or the outside of the transparent medium. The conventionally readable data when viewed from the outside may be a question with the answer conventionally readable when viewed from the inside.

Plastic film is useful as the transparent medium when article wrappers are to be printed. Heavier sheet plastic may be used for transparent multi-colored articles, such as book covers.

A feature of the invention is to have the data viewable from the outside in the form of a question with the answer viewable from the inside.

An advantage of the invention is that conventional printing apparatus may readily be used to practice it, with only the printing medium, such as a printing cylinder, modified so that no printing is done in subareas comprising letters and other data as long as the subareas are coextensive with a solid area of a contrasting color.

In an alternative embodiment of the invention, all of the printing is done on the outside of the transparent medium but the lighter color is printed first except for the subareas comprising data, and then a darker solid area is printed over the data area, so that the data may be conventionally readable when viewed from the inside of the transparent medium.

Other objects, advantages and features of the invention will be apparent from the following detailed description taken with the accompanying drawing in which.

By "conventionally readable" is meant that data in the form of alphabetic characters forming a word appears in the normal sequence, not mirror image or upside down.

Figure 1:
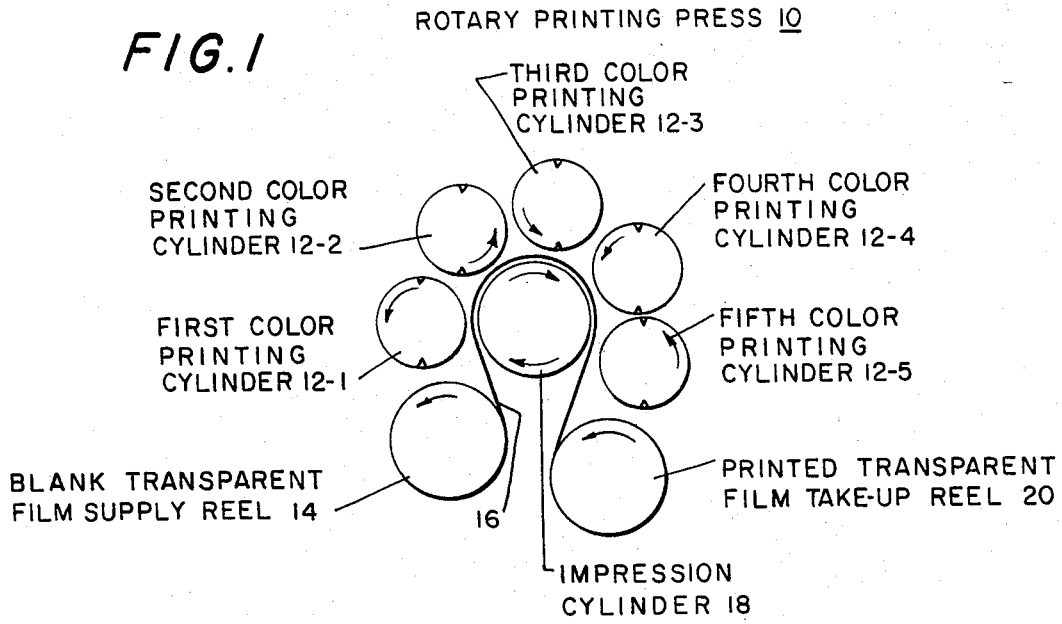
FIG. 1 is a diagrammatic view of a typical rotary printing press for printing on transparent film and which may be employed to practice the invention.

A typical rotary press is shown diagramatically in FIG. 1 as 10. Rotary printing press 10 comprises 1st color printing cylinder 12-1, 2nd color printing cylinder 12-2, 3rd color printing cylinder 12-3, 4th color printing cylinder 12-4 and 5th color printing cylinder 12-5. Blank transparent film supply reel 14 feeds blank transparent film 16 between the color printing cylinders 12 and an impression cylinder 18 to a printed transparent film take-up reel 20. Each of the color printing cylinders 12 is appropriately engraved to print its portion of a multi-colored print on the transparent film 16 in correct registration.

Figure 2:
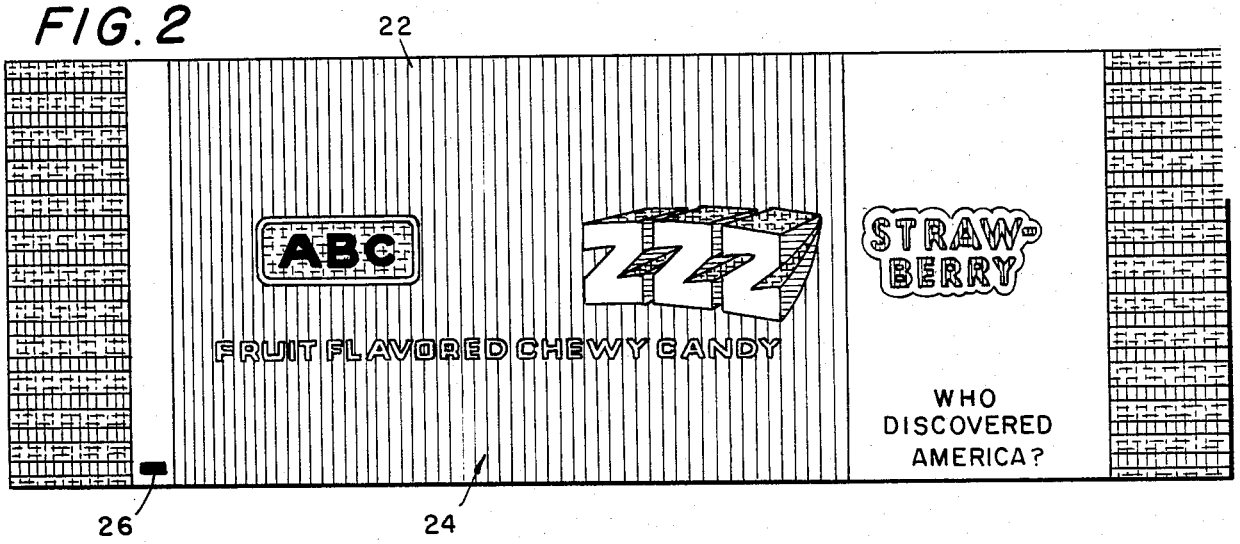
FIG. 2 is a plan view of the outside of a candy wrapper (color coded), printed on the inside of transparent film in accordance with a preferred embodiment of the invention, but with data (such as ingredients) and art work removed for the purpose of simplifying the drawing.

A multi-colored composite print in the form of a candy wrapper 22, printed in accordance with the invention, is shown in FIG. 2. The data "ABC" is printed in black on a yellow background and may be a company trademark. The data "ZZZ" is printed in blue, yellow and white and may be a product trademark. The general background is printed in red and white. Thus five colors are printed on the transparent film 16. In accordance with the invention, a solid area 24, in the illustrated case red, is printed, preferably adjacent to additional data like the question "WHO DISCOVERED AMERICA?"

In accordance with the preferred embodiment of the invention, the candy wrapper 22 is completely printed only on what becomes the inside of the wrapper. The colors are printed on what becomes the inside of the transparent film 16 in an increasingly lighter sequence. Thus, 1st color printing cylinder 12-1 prints the black portion of the multi-colored composite print which is to become candy wrapper 22. For example, 1st color printing cylinder 12-1 is engraved to print in black "ABC." Then 2nd color printing cylinder 12-2 prints the red portion, 3rd color printing cylinder 12-3 prints the blue portion, 4th color printing cylinder 12-4 prints the yellow portion and 5th color printing cylinder 12-5 prints the white portion.

Figure 3:
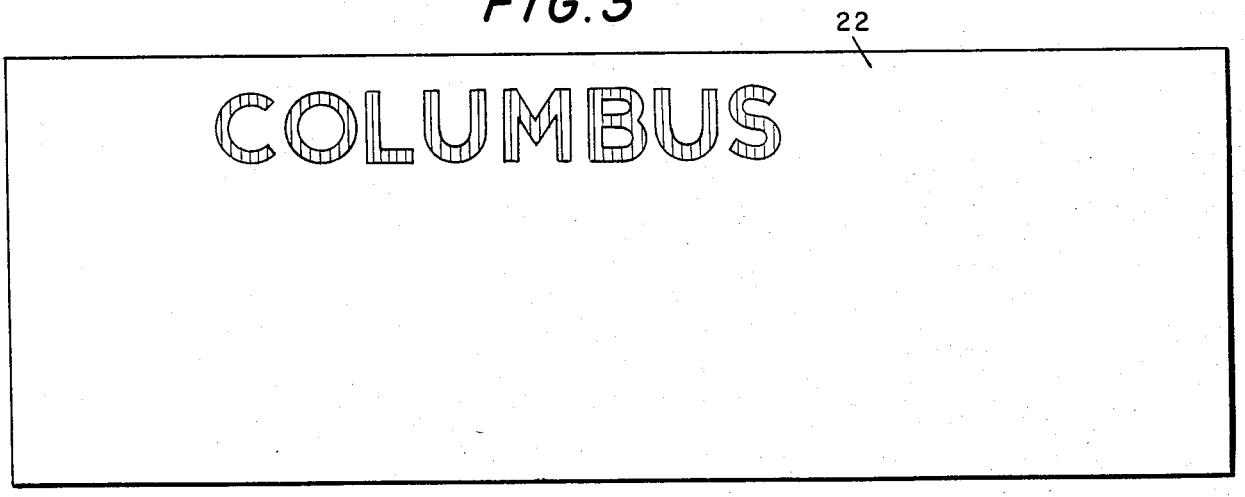
FIG. 3 is a plan view of the inside of the candy wrapper of FIG. 2 showing a conventionally readable answer to a question conventionally printed on the outside of the wrapper, with all of the printing done on only one side of the transparent film in accordance with the invention.

The inside of candy wrapper 22 is shown in FIG. 3. The last color printed, white, generally coats the entire inside of the wrapper 22. The data which is conventionally readable from the outside of the candy wrapper 22, such as "ABC" in black is not shown but would ordinarily be seen in mirror (but not conventionally) readable image through the white coating in lightened form. But what stands out and is conventionally readable when viewed from the inside of the wrapper 22 is the data "COLUMBUS" which is in red. In accordance, with the invention, "COLUMBUS" is conventionally readable because the 5th color printing cylinder 12-5 is engraved to fully coat the inside of the wrapper 22 in white *except* for the letters of "COLUMBUS" where no white ink is printed. Since the absent white ink comprising "COLUMBUS" is coextensive with the earlier printed solid red area 24, "COLUMBUS" appears in red through the white coating of the candy wrapper 22.

Thus, although the entire printing process is on only one side of the transparent film 16, data is conventionally readable when the candy wrapper 22 is viewed from the inside or the outside.

Since a major candy market is children, data in the form of questions on the outside of the candy wrapper 22 and answers on the inside is believed to enhance sales to children.

Of course, other messages such as fortunes may be printed to be viewable from the inside of the candy wrapper 22.

The invention is equally useful when printed on any other transparent medium such as thick transparent plastic sheeting which may be, for example, used for book covers and have data conventionally readable from either side of the printed sheet though only one side is printed.

In accordance with a patentably distinct alternative embodiment of the invention, the candy wrapper 22 may be produced by printing on what becomes the outside of the wrapper 22. In that case the sequence of printed colors is from light to dark. Thus 1st color printing cylinder 12-1 would coat the transparent film 16 entirely in white except for the data "COLUMBUS" which would be unprinted so that the transparent film 22 has transparent letters "COLUMBUS" at that stage of the printing. Then color printing cylinders 12-2 to 12-5 would sequentially print their portions of the composite print as follows: yellow, blue, red and black. The red is printed in the solid area 24 coextensively with the transparent data "COLUMBUS." Thus, when the wrapper 22 is viewed from the inside, "COLUMBUS" appears in red coming through the unprinted portions of the white coating printed by 1st color printing cylinder 12-1.

It should be noted that it is standard printing procedure to print on a transparent film from dark color to light color on what becomes the inside of the wrapper and from light color to dark color on what becomes the outside of the wrapper. But what is believed to be novel is to print two coextensive areas in contrasting colors with the lighter color "stencilled" out in the form of data which is conventionally readable from the inside of the wrapper. While it is preferable that the non-stencilled color coextensive area be a solid area, it may be any background area providing two or more colors which contrast with the lighter color of the stencilled area.

In a specific embodiment of the invention a page of 40 candy wrappers 22 is printed in one full revolution of each of the color printing cylinders 12. 5th color printing cylinder 12-5 is engraved to print 40 different combinations of questions and answers. The candy wrappers 22 on each page are printed so that their shorter side parallels the movement of the transparent film 16. On a printing cylinder with a width of $33\frac{1}{2}$ inches and a perimeter of $28\frac{3}{4}$ inches, 40 candy wrappers 22, each $8\frac{3}{8}$ inches long and $2\frac{7}{8}$ inches wide, are printed on each page in four columns of 10, each column being parallel to the direction of movement of transparent film 16 and $8\frac{3}{8}$ inches wide. Slitting means, not shown, slits the transparent film 16 into four separate $8\frac{3}{8}$ inch parallel sections as the printed film leaves the 5th color printing cylinder 12-5 to be wound on printed transparent film take-up reel 20. A photo detector marker 26 on each candy wrapper 22 is employed in the candy wrapping equipment to signal the beginning and end of each candy wrapper 22. Of course, the invention is equally useful for other alphabets such as Chinese, Hebrew and Arabic.

What is claimed is:

1. A label comprising a multi-colored print adhered to one side of a transparent medium, the print including (a) a first color layer covering an area of the one side of the medium except for unprinted subareas, the subareas forming first readable data which is conventionally readable when viewed from the opposite side of the medium and providing an unintelligible mirror image of such data if viewed from the one side of the medium, (b) a second color layer, the second color layer being darker than the first color layer and covering at least a portion of the first color layer, which portion includes the unprinted subareas, the second color layer being visible as the first readable data through the subareas when viewed from the opposite side of the medium and concealing the mirror image of the first readable data when viewed from the one side of the medium, and (c) means forming second readable data which is conventionally readable when viewed from the one side of the medium so that the transparent medium has conventionally readable data viewable from each side of the medium, and wherein the first readable data is correlated with the second readable data.

2. A print adhered to a transparent medium as constructed in accordance with claim 1 wherein the second and first readable data comprise a question and its answer respectively.

3. A print adhered to a transparent medium as constructed in accordance with claim 1 wherein the transparent medium is adjacent the first color layer.

4. A print adhered to a transparent medium as constructed in accordance with claim 1 wherein the means forming the second readable data comprises a third color layer juxtaposed over the second color layer.

5. A print adhered to a transparent medium as constructed in accordance with claim 4 wherein the third color layer is darker than the second color layer.

6. A print adhered to a transparent medium as constructed in accordance with claim 5 further including a fourth color layer covering at least a portion of the first color layer, the fourth color layer being darker than the third color layer.

7. A print adhered to a transparent medium as constructed in accordance with claim 1 wherein the data comprises a word formed of letter characters.

8. A print adhered to a transparent medium as constructed in accordance with claim 1 wherein the transparent medium comprises a plastic film.

9. A print adhered to a transparent medium as constructed in accordance with claim 1 wherein the transparent medium comprises a plastic sheet.

10. A label comprising a multi-colored print adhered to a side of a transparent medium, the print including (a) first readable data provided on one side of the transparent medium so as to be conventionally readable when viewed from the opposite side of the medium and provide an unintelligible mirror image when viewed from the one side of the medium;

(b) a first color layer covering at least a portion of an area of the one side of the medium; and (c) a second color layer, the second color layer being lighter than the first color layer and covering the first color layer except for at least a portion of the first color layer, which portion forms second readable data of the first color, the second readable data being conventionally readable when viwed from the one side of the medium and wherein the first readable data is correlated with the second readable data.

11. A print adhered to a transparent medium constructed in accordance with claim 10 wherein the first and second readable data comprise a question and answer.

12. A print adhered to a transparent medium constructed in accordance with claim 10 wherein the transparent medium is a plastic film.

13. A print adhered to a transparent medium constructed in accordance with claim 10 wherein the transparent medium is a plastic sheet.

14. A candy wrapper label comprising a multi-colored print adhered to one side of a transparent medium, the print including (a) a first color layer covering an area of the one side of the medium except for unprinted subareas, the subareas forming first readable data which is conventionally readable when viewed from the opposite side of the medium and providing an unintelligible mirror image of such data if viewed from the one side of the medium, (b) a second color layer, the second color layer being darker than the first color layer and covering at least a portion of the first color layer, which portion includes the unprinted subareas, the second color layer being visible as the first readable data through the subareas when viewed from the opposite side of the medium and concealing the mirror image of the first readable data when viewed from the one side of the medium, and (c) means forming second readable data which is conventionally readable when viewed from the one side of the medium so that the transparent medium has conventionally readable data viewable from each side of the medium, and wherein the first readable data is correlated with the second readable data.

* * * * *